United States Patent [19]

Stradley

[11] Patent Number: 5,010,595

[45] Date of Patent: Apr. 30, 1991

[54] SEPARABLE PANTS WITH INTEGRAL UNDERPANTS

[76] Inventor: Carolyn A. Stradley, P.O. Box 1155, Marietta, Ga. 30061

[21] Appl. No.: 498,770

[22] Filed: Mar. 26, 1990

[51] Int. Cl.[5] ..... A41D 1/06; A41D 13/02

[52] U.S. Cl. ..... 2/227; 2/234

[58] Field of Search ..... 2/234, 227

[56] References Cited

U.S. PATENT DOCUMENTS

| | | | |
|---|---|---|---|
| 2,166,088 | 7/1939 | Boetcker | 2/234 |
| 2,166,514 | 7/1939 | Zapis | 2/234 |
| 2,264,958 | 12/1941 | Smith | 2/227 |
| 2,291,589 | 7/1942 | La France | 2/234 |
| 2,336,554 | 12/1943 | Lippmann | 2/234 |
| 2,519,202 | 8/1950 | Slater | 2/234 |
| 2,703,404 | 3/1955 | Lawson | 2/227 |
| 3,425,063 | 2/1969 | Brown | 2/234 |
| 3,823,419 | 7/1974 | Breitbart | 2/227 |
| 4,561,121 | 12/1985 | Ehring et al. | 2/2 |
| 4,578,828 | 4/1986 | Smith, Sr. et al. | 2/234 |
| 4,597,110 | 7/1986 | Smith, Sr. et al. | 2/408 |

*Primary Examiner*—Werner H. Schroeder
*Assistant Examiner*—Gloria Hale

[57] ABSTRACT

A woman's trouser (10) having an outer ply (120 and an integral inner lining (13) sewn to the interior of the trouser. A releasable seam (11) is provided in both the inner lining and the outer ply to allow the wearer to open the crotch portion (18) and seat portion (19) of the trouser for minimal exposure of the buttocks and crotch of the wearer.

13 Claims, 3 Drawing Sheets

SEPARABLE PANTS WITH INTEGRAL UNDERPANTS

FIELD OF THE INVENTION

This invention relates, in general, to outer garments for the lower abdominal region of a woman, and, more particularly, to a woman's trouser having a releasable crotch opening for the purpose of minimally exposing the lower abdomen when urinating, while avoiding exposure of the hips, buttocks, crotch and upper portions of the legs of the wearer.

BACKGROUND OF THE INVENTION

As women have increased their participation in outdoor activities, they have begun to participate more in traditionally all male employment areas such as the military, construction work, and landscaping, for example, which are often removed from readily accessible restroom facilities. Outdoor sports activities, such as hiking and camping also often deny women access to such facilities. When engaged in any of the foregoing activities, women, when relieving themselves, must, out of necessity, remove their trousers or lower garments and their lower undergarment, thereby fully exposing their lower torso outside the private enclosure normally provided by a restroom facility. Thus an attractive garment that can be opened sufficiently to permit a women to relieve herself while minimizing exposure of her hips, buttocks, crotch and legs is greatly to be desired, particularly for active women.

Garments that have sealable openings in the crotch region thereof are found in the prior art, such as are shown in U.S. Pat. Nos. 2,522,421 of Wolf, 2,689,958 of Gray, 2,812,516 of Hoffman, and 3,956,774 of Spaulding. These prior art patents generally show garments for the lower body area that have crotch seams that open for access to the lower area of the abdomen, as for changing a child's diaper or removing an adult person's undergarment, etc. However, the prior art does not disclose an attractive garment for the lower body that can be conveniently opened without subsequent removal of a woman's underpants or similar undergarment to enable the woman to relieve herself without undue exposure of her lower body.

SUMMARY OF THE INVENTION

Briefly described, the present invention comprises a garment to be worn by a woman while engaged in outdoor activities or other activities where restroom facilities are inaccessible. The garment includes an outer pants shell which includes a waist band and leg portions depending from the waist band. Within the outer pants a lining comprising a pair of underpants is sewn or otherwise attached to the inside surface of the pants to function as a undergarment and provide a soft feel to the garment for the comfort of the wearer.

The pants have a releasable separable seam which extends from just below the waist band at the back of the pants downwardly through the seat portion and crotch area of the pants and up to the waist band at the front of the pants. The underpants have the same releasable opening, the edges of the underpants being attached to the edges of the releasable seam of the pants. In a preferred embodiment of the invention a slide fastener is provided for opening and reclosing the releasable seam for normal wearing of the garment, although a Velcro fastener or other type of nonobstructive continuous fasteners can be used.

When the pants are being worn, the releasable seam normally can be opened by the user pulling the slide connector of the slide fastener along the releasable seam downwardly from the front waist band through the crotch area of the pants and upwardly through the seat area toward the rear waist band. If Velcro strips are used, the releasable seam can be opened by pulling at the seam, to separate the seam. This opens the seams of both the pants and the underpants. To close the seam, the slide of the slide fastener is pulled forwardly along the seam, or if Velcro is used the sides of the seam are simply pressed together to bring the sides of the seam into contact, thus resealing the seam in the pants and underpants. The pants have a tendency to fit the shape of the wearer, with the sides of the seams becoming aligned. Consequently, wrinkles or folds in the releasable seam are not likely to occur when the pants are being closed and worn by the wearer.

Thus, it is an object of this invention to provide a means for opening and releasing a woman's pant garment at the crotch portion of the pants to permit the user to relieve herself with only a minimal exposure of the buttocks and crotch of the wearer and without necessitating the removal of the garment.

Another object of the invention is to provide an attractive, versatile and comfortable pants garment for use by a women in situations where private restrooms are not available and which permit the woman to open the crotch area of both pants and underpants to minimally expose the lower abdomen for the purpose of relieving herself.

Other objects, features and advantages of the present invention will become apparent upon a reading of the following detailed description in conjunction with the accompanying drawings.

DESCRIPTION OF THE PREFERRED EMBODIMENT

Figure 1:
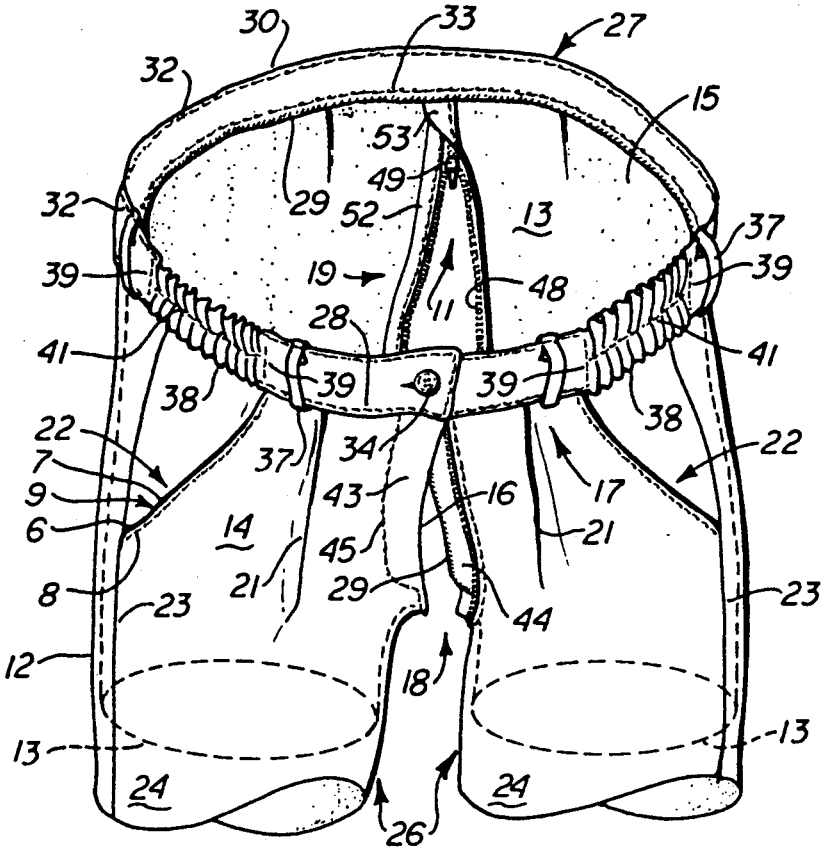
FIG. 1 is a front perspective view of the upper portion of a woman's pants garment with a releasable opening.

Referring now in greater detail to the drawings in which like numerals indicate like parts throughout the several views, FIG. 1 illustrates a women's trousers or pants 10 having a releasable seam 11 formed therein for opening the pants 10 to expose the crotch and buttocks of the wearer. The pants 10 have an outer ply 12 which forms an outer pair of pants of a polyester blend material which provides comfort of wearing and a fashionable yet durable appearance. An inner lining 13 is provided inside the outer ply 12 to form inner or underpants 15 with the underpants 15 being made of a nylon material having a satiny finish to give the inside of pants 10 a soft feel, for enhancing the comfort of the wearer.

As shown in FIG. 1, the pants 10 include a trunk portion 14 which covers the lower abdomen of the wearer. The trunk portion 14 includes a front opening 16, an upper portion 17 encircling the waist of the wearer, and a crotch region 18 at the lower portion of the trunk portion 14 and a seat portion 19 at the rear of the pants 10 through which the releasable opening 11 extends. Pleats 21 are formed in the front of the trunk portion 14 adjacent front opening 16, extending downwardly from the upper portion 17 of the trunk portion 14. The pleats 21 provide the pants 10 with a more fashionable and attractive appearance.

Side pockets 22 are formed in the trunk portion 14. Vertical side seams 23 are lapped seams formed on the sides of the outer ply 12 approximately in the area of the hips of the wearer, and extend along the length of the leg portions 24 of the pants 10.

The approximately cylindrical leg portions 24 are each formed by the side seams 23 affixing the portions of the outer ply material along the outside edge of the leg portions 24, and an inseam 26 affixing the portion of the outer ply material along the inside of the leg portions 24. The inseams 26 extend from the top of the leg portions 24 adjacent the crotch region 18 of the pants 10 downwardly toward the bottom of the leg portions 24. The leg portions 24 extend from opposite sides of the crotch region 18 diverging outwardly from one another and are of a length sized to fit a wearer of a particular height and weight.

Figure 2:
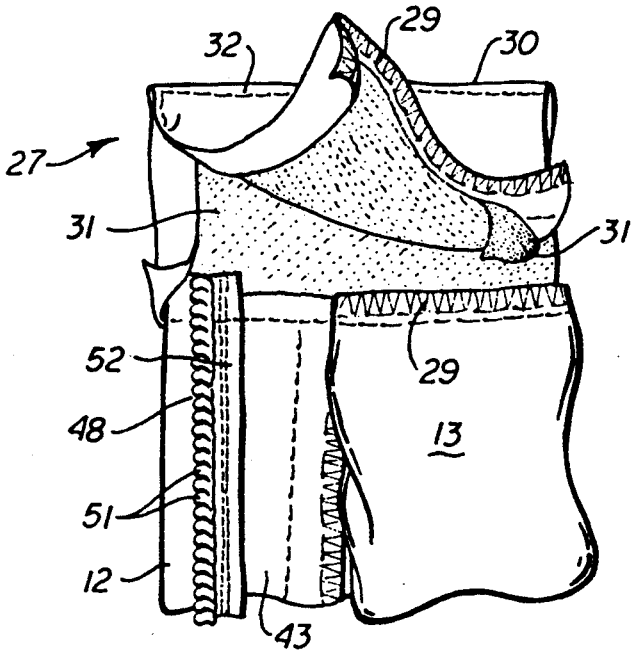
FIG. 2 is a side view of a portion of the waist band of the garment, showing the waist band opened so as to expose the details of the construction of the waist band.
Figure 3:
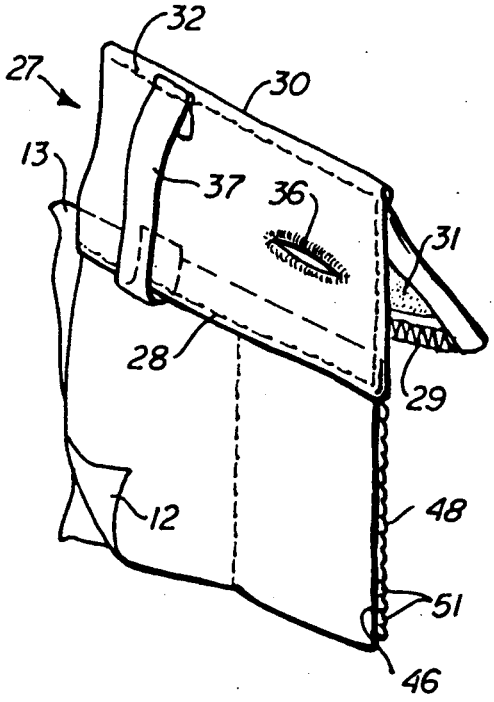
FIG. 3 is a perspective illustration of an end of the waist band adjacent the front opening of the garment, showing the bottom and end edges open.

A waist band 27 is sewn about the upper portion 17 of the pants 10 so as to surround the waist of the wearer. The waist band 27 is a substantially continuous circle interrupted only at the front of the pants 10 by the front opening 16. As shown in FIGS. 2 and 3, the waist band 27 is formed from a strip of the same material as the outer ply 12, so as to match the outer ply 12. The strip of material is folded in half and sewn in place about the upper portion 17 of the pants 10. On the outside surface of the outer ply 12, the lower edge 25 of the waist band 27 is folded up under the waist band 27 to form a hem with a clean lower edge 25. This lower edge 25 is secured with a lock stitch 28 to the upper portion 17 of the trunk portion 14. The edge of the portion of the waist band 27 which is on the inside surface of the pants 10 is hemmed with an over edge stitch 29.

Material functioning as a waist band liner 31 is sewn inside the waist band 27 by a stitch 32 at the top of the waist band 27, adjacent the fold 30. The waist band liner 31 is secured at the bottom of the waist band 27 by the stitch 28 on the outside surface of the outer ply 12 and the over edge stitch 29 (FIG. 4) on the inside surface of the outer ply 12. This waist band liner 31 (FIG. 2) provides added stiffness and stability to the waist band 27 as FIGS. 2 and 3 illustrate.

The top edge of the upper portion 17 of the trunk 14 and the top edge of the inner lining or underpants 13 are inserted into the waistband 27 between the strips of the waistband liner 31, and are sewn in place by the lock stitch 28 on the outside surface of the pants 10 and by a chain stitch 33 (FIG. 4) on the inside surface of the pants 10, adjacent the over edge stitch 29 formed along the lower edge of the waist band 27. Thus, the inner lining 13 is secured to the outer ply 12 of the outer pants 10.

The ends of the waist band 27 adjacent the front opening 16 are linked together by a button 34, sewn to the waistband at the left side edge of the waistband 27, being inserted into a button hole 36, formed adjacent the right side edge of the waistband 27. By inserting button 34 into button hole 36, the waist band 27 is thus closed in a circle about the waist of the wearer. It should be noted that snaps, hooks or other conventional fasteners can be used in place of button 34 and button hole 36 to close the waistband 27 about the waist of a wearer.

Optionally, belt loops 37 are attached to the waistband 27 at various points along the waistband 27. The belt loops 37 are formed from folded strips of the same material as the waistband 27 and the outer ply 12. As illustrated in FIG. 2 the lower end of belt loops 37 is tucked under the lower edge of the waist band 27 and is secured by lock stitch 28. The upper end of the belt loops 34 is folded over behind the belt loops 37, and secured to the top of the waist band 27 adjacent the fold of the waistband 27 by fold lock stitch 32. A belt (not shown) can be inserted through the belt loops 37, encircling the waist of the wearer to provide a means for securing the pants 10 about the waist of the wearer.

As shown in FIG. 1, elastic darts 38 are provided between the belt loops 37 at the front of the pants 10 for an additional means of securing the pants 10 about the waist of the wearer. A rectangular section of an elastic material (not shown) is placed inside the waistband 27 of the pants 10 between the belt loops 37 at the front of the pants 10. The elastic material is sewn to the waist band 27 on the outside surface of the pants 10 by vertical chain stitch 39 at each side edge of the elastic material and by a horizontal lock stitch 41 across the elastic darts 38 partially along the length of the waistband 27.

Figure 4:
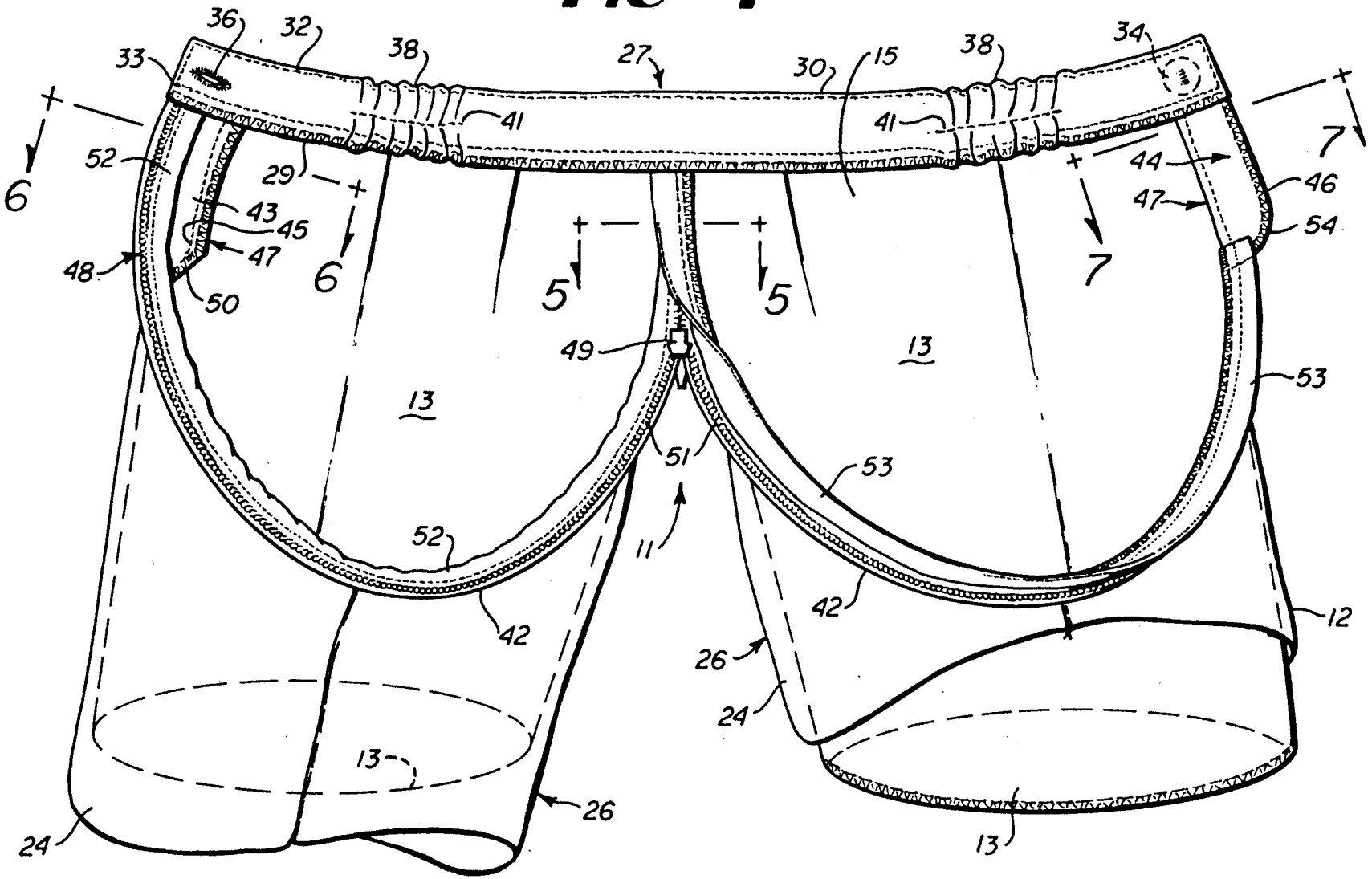
FIG. 4 is an elevational view of the garment with the garment opened along its releasable seam.

As illustrated in FIG. 4, the top of the inner lining of underpants 13 of the pants 10 is secured by the waistband 27. The inner lining 13 extends downwardly from the waistband 27 into the leg portions 24 of the pants 10, terminating at about the upper thigh level of the wearer (as shown in dashed lines). The inner lining 13 is sewn into the inner surface of the outer ply 12 at other strategic points such as along the side edges 42 of the releasable seam 11 to attach the inner lining 13 to the outer ply 12. Such construction reduces the possibility of the inner lining 13 bunching up or becoming tangled up with the outer ply 12.

Figure 6:
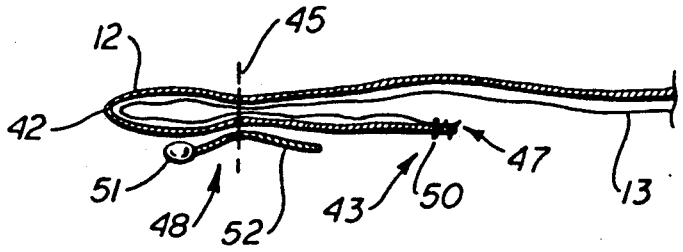
FIG. 6 is a plan view of the construction of the releasable seam at the right side placket, adjacent the front opening of the garment, taken along lines 6—6 of FIG. 4.
Figure 5:
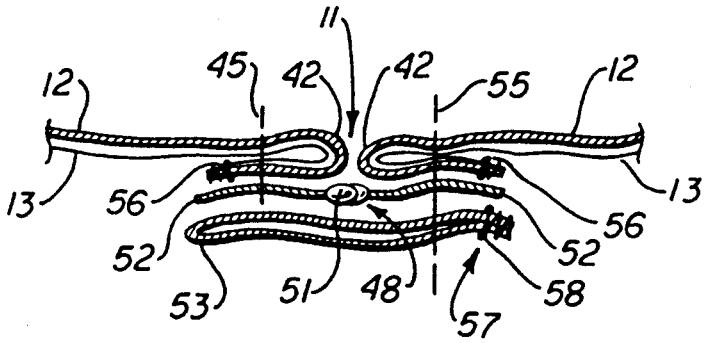
FIG. 5 is a cross sectional view of a portion of the releasable seam of the garment, taken along lines 5—5 of FIG. 4, showing the construction of the releasable seam at the rear of the garment with the seam closed.
Figure 7:
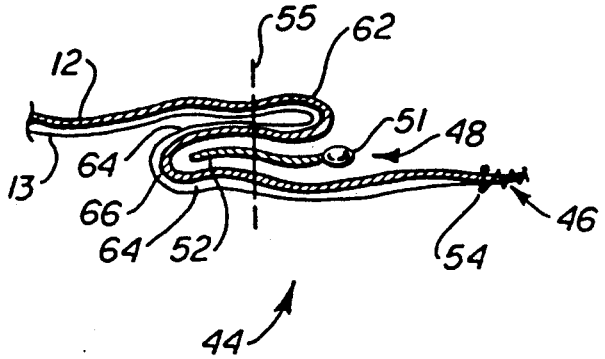
FIG. 7 is view of the construction of the releasable seam at the left side placket, adjacent the front opening of the garment, taken along line 7—7 of FIG. 4.

As FIG. 1 illustrates, the releasable seam 11 of the pants 10 extends downwardly from immediately adjacent the bottom edge of the waistband 27 at the front opening 16 of the pants 10, then rearwardly through the crotch region 18 and then upwardly through the seat portion 19 of the pants 10, ending at the bottom edge of the waistband 27 at the rear of the pants 10. Plackets 43 and 44 (FIG. 4) are sewn to the releasable seam 11 on each side edge 42 of the releasable seam 11 adjacent front opening 16 of the pants 10. The side edges 42 are formed by folds in the inner and outer plys of materials (FIGS. 5–7). As illustrated in FIG. 4, each placket 43 and 44 is an approximately J-shaped piece of material sewn to the side edges 42 of the releasable seam 11. The placket 43 on the right side of the releasable seam 11 is outlined on the outer surface of the pants 10 (FIG. 1) by a lock stitch 45 which secures the placket 43 to the pants 10, and is hemmed along the innermost edge 47 (FIG. 4) by an overedge stitch 50. As shown in FIG. 4, the placket 44 on the left side of the releasable seam 11 is overlaid with a ply of the same nylon material as the inner lining 13, sewn to the placket 44 on its outermost edge 46 by an over edge stitch 54, and along its innermost side edge 47 by a lock stitch 55. When the pants 10 are closed, the right side placket 43 overlaps the left side placket 44 so as to provide the front opening 16 of the pants 10 with the appearance of a single fly opening. The ply of overlaid nylon inner lining 13 material offers a smooth feel to the wearer at the front center of the garment. Thus, the plackets 43 and 44 give the pants 10 the appearance of conventional trousers as well as provide greater stiffness and support to the releasable seam 11 in the area of the front opening 16 and the crotch region 18.

As illustrated in FIGS. 4–6, folds in both the overlying inner and outer plys of the underpants and outer pants form side edges 42 of the releasable seam 11 and the edges 42 are held in place by the opposing edges of a fastening means such as a slide fastener 48 for conventional work clothes. Other types of non-obstructive continuous fasteners, such as Velcro strips can be used for more casual garments, such as sweat pants, with the contacting Velcro strips each attached to a different side edge 42 of the releasable seam 11. Slide fastener 48 has a slide connector 49 which moves along the length of the releasable seam 11 to pull the opposing toothed surfaces 51 of the slide fastener 48 into engagement with one another.

As shown in FIG. 5 the opposing toothed surfaces 51 of the slide fastener 48 are affixed on each side of the releasable seam 11 to a selvage 52 and the selvage 52 is sewn to the folded portions of the inner and outer plys of the underpants and outer pants which form the side edges 42 of the releasable seam 11 by a double row of lock stitches so as to firmly attach the opposing toothed surfaces 51 of the slide fastener to the releasable seam 11. The selvedge 52 on the left side of the releasable seam 11 is overlaid with a folded band of material which functions as a shield or guard 53 to protect the wearer's skin from the slide fastener 48, thus, the skin of the wearer is kept from being engaged by and becoming caught between the opposing toothed surfaces 51 of the slide fastener 48.

As FIG. 5 illustrates, the side edges 42 of the releasable seam 11 are constructed by the outer ply 12 and the inner lining 13 being hemmed together at their aligned edges with an overedge stitch 56 and folded over inside the pants 10 (FIG. 1). Each side edge 42 (FIG. 5) of the folded outer ply material 12 along the releasable seam 11 is overlaid with a selvedge 52 and toothed surfaces 51 of the slide fastener 48. The folded shield or guard strip 53 is hemmed along its aligned edges 57 with an overedge stitch 58 and extends from the left side edge 42 of the releasable seam 11 across the width of the releasable seam 11 to the right side edge 42 of the releasable seam 11 so as to completely cover the toothed surfaces 51 of the slide fastener 48 when the releasable seam 11 is closed. A lock stitch 55 on the left side edge 42 of the releasable seam 11 secures the folded outer ply 12 and inner lining 13 to the selvedge 52 of the slide fastener 48 and to the rear edge 57 of the guard strip 53. Lock stitch 45 secures the folded outer ply 12 and inner lining 13 to the selvedge 52 of slide fastener 48 on the right side edge 42 of the releasable seam 11, but does not secure the guard strip 53 to the right side edge 42 of the releasable seam 11.

The plackets 43 and 44 (FIG. 4) along the releasable seam 11 at the front opening 16 (FIG. 1) of the pants 10 are formed in a substantially similar fashion to the construction of the releasable seam 11, illustrated in FIG. 5. As illustrated in FIG. 6, the right side placket 43 is formed by the outer ply 12 and the inner lining 13 being folded over at the side edge 42 of the releasable seam 11. The selvedge 52 and tooth surfaces 51 of the slide fastener 48 are overlaid on the folded material, adjacent the outer edge 46 of the right side placket 43. The selvedge 52 is sewn to the folded material with a lock stitch 45 as shown in FIG. 6.

FIG. 7 illustrates the construction of the left side placket 44. The inner lining 13 and the outer ply 12 are folded twice in a substantially S-shaped configuration. The outer fold 62 forms an outer hem adjacent the toothed surfaces of the slide fastener 48. The selvedge 52 of the slide fastener 48 is secured within the side edges 64 of the inner fold 66 by a lock stitch 55.

As illustrated in FIG. 5, the folded edges of the outer ply material overlap the toothed surfaces 51 of the slide fastener 48 on the outside surface of the pants, so as to cover the slide fastener 48 from view. As a result, when the releasable seam 11 (FIG. 1) is fully closed, the pants 10 appear to have a double french seam (shown in FIG. 5) extending through the crotch region 18 (FIG. 1) and the seat portion 19 of the pants, instead of a slide fastener.

When the woman wearing the pants 10 is confronted with a situation whereby she must relieve herself, she simply pulls the slide connector 49 of the slide fastener 48 downwardly and toward the rear of the pants 10 along the length of the releasable seam 11 to disengage the toothed surfaces 51 of the slide fastener 48 thus creating a narrow vertically oriented opening (FIG. 1) in the crotch region 18 and the seat portion 19 both the underpants and outer pants of the garment. If the pants 10 have been provided with Velcro strips for use as a fastening means, the wearer simply tugs on the pants 10 with her fingers at points adjacent the releasable seam 11 on opposite sides thereof to pull apart the side edges 42 of the releasable seam 11 to open the pants 10. The resultant opening provides minimal exposure to the buttocks and crotch of the wearer as she relieves herself.

When the wearer wishes to reclose the opening in the pants 10, she merely pulls the slide connector 49 of the slide fastener 48 toward the bottom and front regions of the pants 10 along the length of the releasable seam 11. As the toothed surfaces 51 of the slide fastener 48 are pulled into engagement with each other by the slide connector 49, the side edges 42 of the releasable seam 11 are pulled together to thus completely close the opening. Where Velcro strips are used as a fastening means, the wearer simply presses the side edges 42 of the releasable seam 11 together with one side overlapping the other to reseal the opening as the Velcro strips contact and adhere to one another.

The design of the pants 10 is such that upon closure of the releasable seam 11, the pants 10 conform to the shape of the person wearing them, and there are no outwardly noticeable signs of the presence of the releasable seam because the releasable seam is located in exactly the same position as a conventional seam of the prior art garments. The fastening means for the releasable seam is flexible so that the releasable seam tends to naturally become aligned with the contours of the body of the wearer, thus, there is little likelihood of folds or wrinkles being formed about the releasable seam when the seam is closed and the pants are being worn by the wearer.

While this invention has been described in detail in a preferred embodiment, it will be understood that numerous additions, deletions and modifications may be readily made thereto without departure from the spirit and scope of the invention as set forth in the following claims.

I claim:

1. A woman's garment constructed of fabric comprising:

outer pants having front, side, and rear portions and a waist band with leg portions depending therefrom separate from one another to form a crotch portion in said outer pants;

an inner lining affixed to the interior of said outer pants about the waist band of said outer pants and conforming to the shape of the interior of said outer pants;

a releasable seam having opposed side edges within the fabric of said outer pants extending from immediately below the waist band at the rear portion of said outer pants and downwardly through the crotch portion and upwardly toward the front portion of said outer pants;

a seam having opposed side edges within the fabric of said inner lining;

the side edges of the seam of said inner lining being attached to the corresponding side edges of the releasable seam of said outer pants for creating a single releasable opening within said outer pants and said inner lining to expose the buttocks and crotch of the wearer; and said releasable opening extending from immediately below said waistband at the rear portion of said outer pants downwardly through said crotch portion of said outer pants and upwardly toward the front portion of said outer pants immediately below said waistband.

2. The woman's garment of claim 1 wherein said releasable seam for creating a single opening within said outer pants and said inner lining comprises a fastening means having a pair of contacting surfaces mounted each to a different opposing side edge of said releasable seam for allowing ease of opening of said seam and for providing secure closing of said seam during the wearing of the garment.

3. The woman's garment of claim 1 wherein said releasable seam when closed conforms to the contours of said outer pants and said inner lining as the garment is worn, thereby eliminating any wrinkles formed upon the closing of said releasable seam.

4. The woman's garment of claim 1, wherein when said releasable seam is open the garment tends to conform to the contour of the body of the wearer and tends to limit the size of the opening formed in the crotch area when the garment is being worn in the normal manner to minimize the exposure of the crotch the wearer.

5. The woman's garment of claim 1 and wherein said waist band includes a button fastener at the front portion of said outer pants whereby said waist band at the front portion of said outer pants is opened and closed by the woman when putting on or removing the garment.

6. The woman's garment of claim 2, wherein said fastening means is a zipper fastener.

7. The woman's garment of claim 2 and further including an interior flap extending parallel to and covering said fastening means from the rear of the garment at the waist band and through the crotch portion.

8. A woman's trousers, comprising:

outer pants having front, side and rear portions and a waist band;

leg portions depending from said waist band and forming a crotch portion in said outer pants;

said outer pants having a releasable seam extending from adjacent said waist band at the rear portion of said outer pants through said crotch portion upwardly toward said waist band portion at the front portion of said outer pants, said seam having first and second opposed edges;

an inner lining attached to the interior of said outer pants at said waist band said inner lining having a crotch portion and an openable crotch seam extending therethrough coincident with said releasable seam of said outer pants, the edges of said crotch seam being attached to the corresponding first and second edges of said releasable seam to form an integral releasable crotch seam for both said outer pants and said inner lining so that both of said outer pants and inner lining can be simultaneously opened or closed at the crotch of the wearer of the trousers by opening the integral releasable crotch seam.

9. The woman's trouser as claimed in claim 8 wherein a fastening means is attached to said first and second edges.

10. The woman's trouser as claimed in claim 9 wherein said fastening means is Velcro.

11. The woman's trouser as claimed in claim 9 wherein said fastening means is a zipper.

12. The woman's garment of claim 9 and further including an interior flap extending parallel to and covering said fastening means from the rear of the garment at the waist band and through the crotch portion.

13. A woman's pair of pants, comprising:

a pair of outer pants having front, side and rear portions, and a waist band encircling said outer pants with leg portions depending therefrom to form a crotch area in said outer pants, a releasable seam having first and second opposing sealing edges, extending from immediately below said waist band at the rear portion of said outer pants downward through the crotch area and upward toward said waist band at the front portion of said outer pants;

an inner lining affixed to the interior of said outer pants along said waist band and within said leg portions and having a crotch area and a crotch seam extending therethrough coincident with said releasable seam;

said crotch seam of said inner lining having opposed side edges attached to the corresponding sealing edges of said releasable seam in said outer pants;

a reclosable fastening means having opposing fastening surfaces affixed to the corresponding sealing edges of said releasable seam for opening and completely closing said releasable seam in said outer pants;

said waist band of said outer pants including an opening at the front portion of said outer pants, and a button faster on one side portion of said opening engaging a slot in an opposing side portion of the opening in said waist band to open or close said waist band as the woman wearing the pants puts on or removes the pants.

* * * * *